US007428886B1

(12) United States Patent
Minculescu

(10) Patent No.: US 7,428,886 B1
(45) Date of Patent: Sep. 30, 2008

(54) TWO-CYCLE ENGINE AND COMPRESSOR

(76) Inventor: Mihai C. Minculescu, 25 Brentwood Rd., Boothwyn, PA (US) 19061

( * ) Notice: Subject to any disclaimer, the term of this patent is extended or adjusted under 35 U.S.C. 154(b) by 0 days.

(21) Appl. No.: 11/627,546

(22) Filed: Jan. 26, 2007

(51) Int. Cl.
*F02B 33/10* (2006.01)

(52) U.S. Cl. ..... 123/71 R; 123/62

(58) Field of Classification Search ..... 123/62, 123/71 R
See application file for complete search history.

(56) References Cited

U.S. PATENT DOCUMENTS 2,265,285 A * 12/1941 Hermann ..... 417/316
3,557,761 A * 1/1971 Wenzel, Sr. ..... 123/53.4
4,138,972 A * 2/1979 Wilson ..... 123/71 R
4,206,727 A * 6/1980 Siegien ..... 123/66
4,785,770 A * 11/1988 Yang ..... 123/71 R
5,050,570 A * 9/1991 Thring ..... 123/556
5,572,904 A 11/1996 Minculescu
5,694,891 A * 12/1997 Liebich ..... 123/68
5,791,303 A * 8/1998 Skripov ..... 123/71 R
5,884,590 A * 3/1999 Minculescu ..... 123/71 R

* cited by examiner

*Primary Examiner*—Stephen K. Cronin
*Assistant Examiner*—Jason Benton
(74) *Attorney, Agent, or Firm*—Mark A. Garzia; Law Offices of Mark A. Garzia

(57) ABSTRACT

An oscillating lever arm engine includes rigidly connected opposing pistons moved by a single lever connected to a rotating crankshaft. When applied to a two-cycle internal combustion engine, one piston may function as a pump piston and the second piston as a working piston which delivers power to the crankshaft through a connecting rod. When the pump piston is chosen to be of larger diameter, the volumetric efficiency of drawing in and providing the intake charge to the working piston may be increased. Furthermore, when poppet-type inlet and exhaust valves are used, valve timing may be selected so that the exhaust valve closes prior to the inlet valve closing while the pump piston is supplying an intake charge through a transfer duct to achieve a supercharging effect.

15 Claims, 4 Drawing Sheets

TWO-CYCLE ENGINE AND COMPRESSOR

FIELD OF THE INVENTION

The present invention relates to internal combustion engine structures and, more particularly, pertains to an oscillating lever arm engine for generating rotation torque through the oscillating movement of lever arms.

BACKGROUND OF THE INVENTION

The use of many different types of internal combustion engine structures is known in the prior art. More specifically, internal combustion engine structures to convert rotary to reciprocating motion heretofore devised and utilized are known to consist basically of familiar, expected and obvious structural configurations, notwithstanding the myriad of designs encompassed by the crowded prior art which have been developed for the fulfillment of countless objectives and requirements.

Known prior art internal combustion engine structures include those disclosed in U.S. Pat. No. 5,255,572; U.S. Pat. No. 5,113,808; U.S. Pat. No. 5,067,456; U.S. Pat. No. 5,060,609; and U.S. Pat. No. 4,352,343.

While these devices fulfill their respective, particular objectives and requirements, the aforementioned patents do not disclose an oscillating lever arm engine for generating rotational torque through the oscillating movement of a lever arm which includes an elongated cylinder having a pair of pistons oppositely disposed within the cylinder, coupled together by a connecting rod with at least one lever arm pivotally mounted to the connecting rod between the pistons and also pivotally mounted at a medial portion thereof the exterior cylinder, wherein oscillating of the lever arm in response to the piston movement is translated into rotational movement of an adjacent flywheel.

Furthermore, the prior examples of oscillating piston devices, including pumps and compressors, do not take advantage of the possibilities for applying their advantages to two-cycle engines where there is a need to remove oil contamination presently used in two-cycle fuels. Additionally, it has gone completely unappreciated the possibilities for utilizing the advantages of an oscillating piston engine for supercharging a two-cycle engine or increasing the volumetric efficiency of the fuel/air charge delivered to the combustion chamber. In these respects, the oscillating lever arm engine according to the present invention substantially departs from the conventional concepts and designs of the prior art, and in so doing provides an apparatus primarily developed for the purpose of generating rotational torque through the oscillating movement of only one lever arm.

The present invention is related to U.S. Pat. No. 5,884,590, issued Mar. 23, 1999, titled "Two-Stroke Engine," and U.S. Pat. No. 5,572,904, titled "Oscillatory Lever Arm Engine", by the same inventor. These two previous patents similarly describe a lever arm engine with oscillating pistons generally of the type disclosed herein. U.S. Pat. Nos. 5,884,590 and 5,572,904 are hereby incorporated by reference as though fully set forth herein.

SUMMARY OF THE INVENTION

Similar to the general concept presented in the embodiments disclosed in the previous U.S. Pat. No. 5,884,590, the present invention generally comprises an engine for generating rotational torque through the oscillating movement of a single lever arm. The inventive device includes an elongated cylinder having first and second opposed cylinder heads. A pair of pistons are oppositely disposed within the cylinder and coupled together by a connecting rod. A single lever arm is pivotally mounted at a first end thereof to the connecting rod between the pistons. The lever arm is also pivotally mounted at a medial portion thereof exterior of the cylinder to a mounting plate. A flywheel is rotatably mounted to the mounting plate and engages a second end of the lever arm, whereby oscillation of the lever arm in response to piston movement is translated into rotational movement of the flywheel.

The present invention teaches a new oscillating lever arm engine apparatus and method which has many of the advantages of the internal combustion engine structures mentioned heretofore and many novel features that result in an oscillating lever arm engine which are not anticipated, or implied by any of the prior art internal combustion engine structures.

The present invention further teaches an oscillating piston engine for use in two-cycle operation in which the crankshaft is isolated from the intake charge so that the fuel charge need not contain lubricating oil.

The present invention also teaches a two-cycle engine with the possibility of supercharging, in which the intake air charge is greater than that of the swept volume of the working piston delivered to the combustion space throughout each operating cycle.

The present invention further teaches the simplicity of a single lever oscillating piston reciprocating device which eliminates piston side thrust that may be employed as a pump or compressor. The device may be employed as an internal combustion engine pump or compressor. When used in the application of an internal combustion engine, the lever system provides high torque, even at low RPM.

The present invention is an oscillating lever arm internal combustion engine which is capable of running on a variety of different fuels (e.g., gasoline, diesel, alcohol, propane or hydrogen). Furthermore, this device which is very compact and lightweight, is inexpensive to manufacture when considering both material used and labor for assembly.

The present invention overcomes the drawbacks of the lever arm engine disclosed in U.S. Pat. No. 5,884,590.

The various features of novelty which characterize the invention, are pointed out with particularity in the claims annexed to, and forming a part of, this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1A:
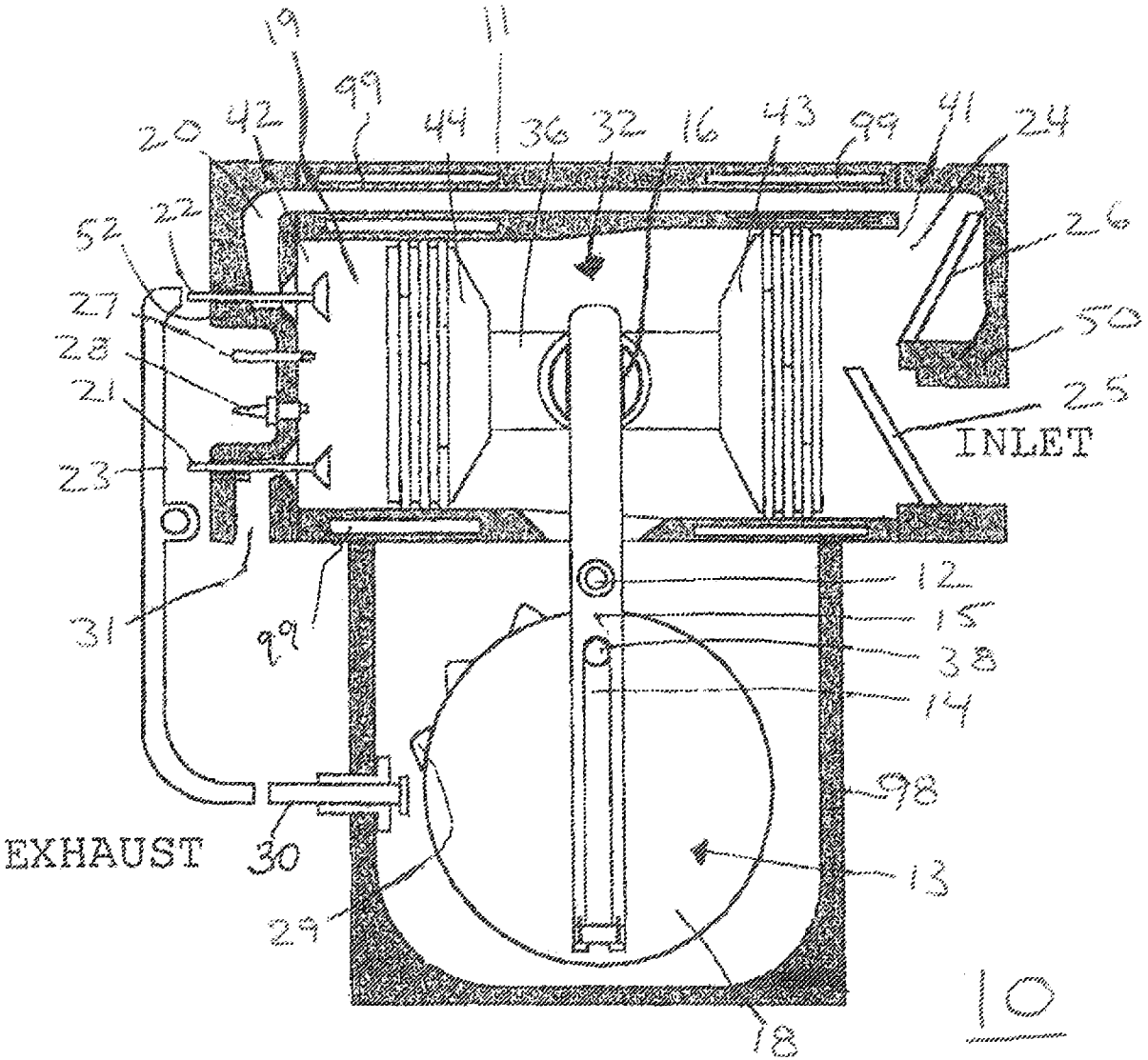
FIG. 1A is a front elevational cross-sectional diagrammatic view of a two-cycle engine in accordance with the present invention.

The description of the preferred embodiment shown in the figures of drawing is shown only diagrammatically. However, it will be understood by those skilled in the art how to select from among available design choices to construct the claimed device from these teachings. Further, for greater detail of the particular working structures that may be used in carrying out the claimed invention, reference may be made to applicant's U.S. Pat. No. 5,884,590 which is incorporated herein as if fully set forth.

In summary, the present invention is a two-cycle engine comprising an elongate cylinder block having opposing first and second coaxial cylinders; a piston assembly designed to slide within said cylinder block in an oscillating manner, said piston assembly having a first piston and a second piston, said first piston and a second piston fixedly coupled to and diametrically opposed; a first cylinder head coupled to the end of said first cylinder, and a second cylinder head coupled to the end of said second cylinder; said piston assembly defining a pumping space between said first piston and the interior of said first cylinder head and also defining a combustion space between said second piston and the interior of said second cylinder head; a transfer duct for providing fluid communication between said pumping space and said combustion space, said transfer duct providing a pressurized intake charge from said pumping space to said combustion space; a connecting rod extending between said first and said second pistons; a housing for storing a lubricating liquid (oil); a crankshaft positioned within said housing, said crankshaft rotatably movable; means affixed to said connecting rod for converting the oscillating motion of said first and second pistons into rotary motion of the crankshaft; one-way valve means in said first cylinder head for controlling the flow of an intake charge into said pumping space; a first lifter valve means in said second cylinder head for controlling the flow of an exhaust charge from said combustion space to ambient air external to said cylinder block; a second lifter valve means in said second cylinder head for controlling the flow of said intake charge from said transfer duct; means for introducing a fuel charge into said combustion chamber; ignition means located in said second cylinder for igniting a fuel charge; a plurality of cams located on the perimeter of said crankshaft, said cams communicating with a lifting rod which causes a rocker arm to control the operation of said first and second lifter valve means; and exhaust means in fluid communication with said combustion space, whereby oscillation of said coupled pistons draws an intake charge into said pumping space and then forces said intake charge from said pumping space through said duct means to said combustion space, wherein said second piston compresses said charge, and upon ignition, said ignited charge drives said second piston forceably, turning said crankshaft and wherein said means for converting the oscillation of said pistons to rotary motion of a single crankshaft, comprises a lever arm, rotatably and slidably mounted to said cylinder block.

Figure 1B:
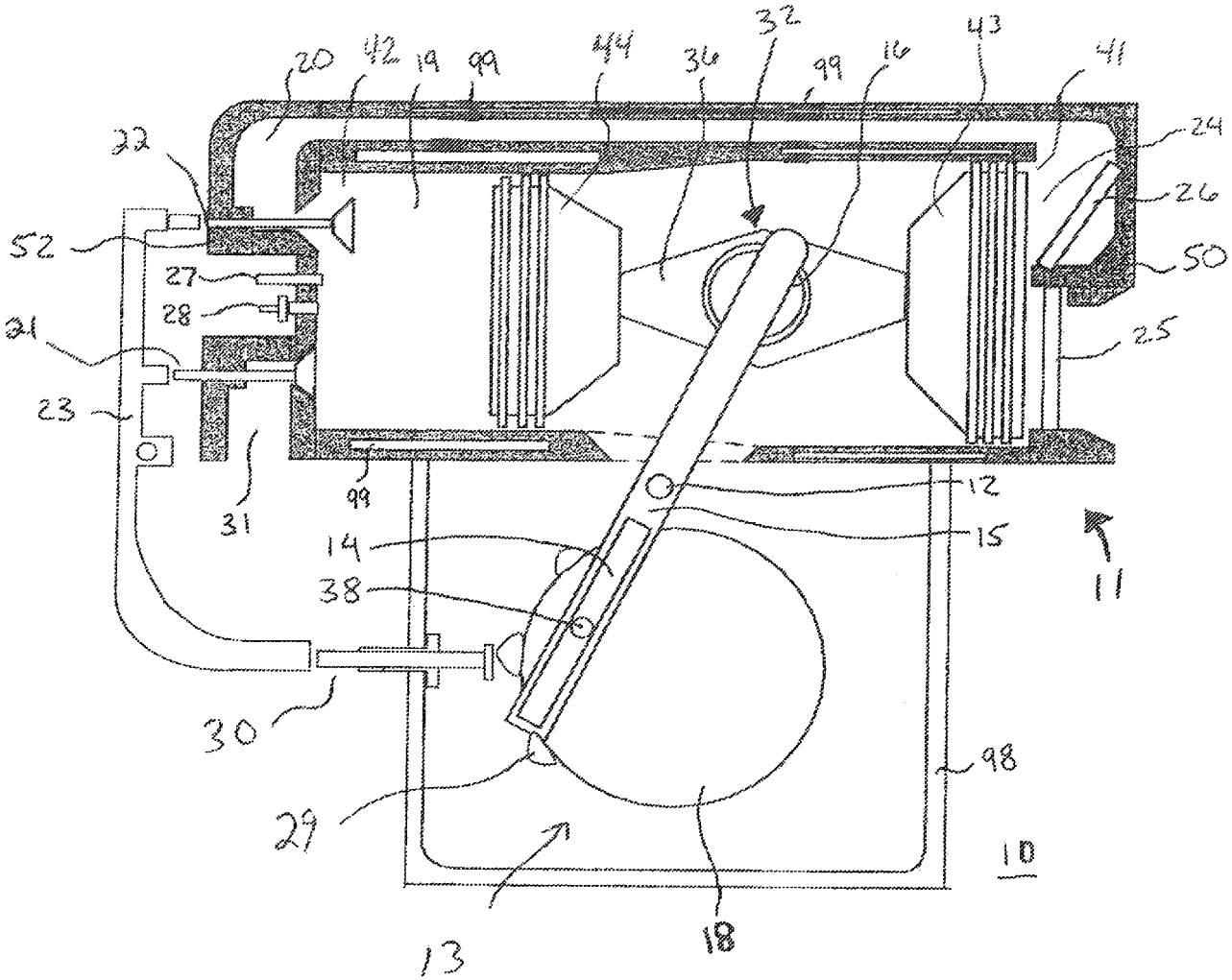
FIG. 1B is a front elevational cross-sectional diagrammatic view of the two-cycle engine shown in FIG. 1A at a different point in its combustion cycle.
Figure 1C:
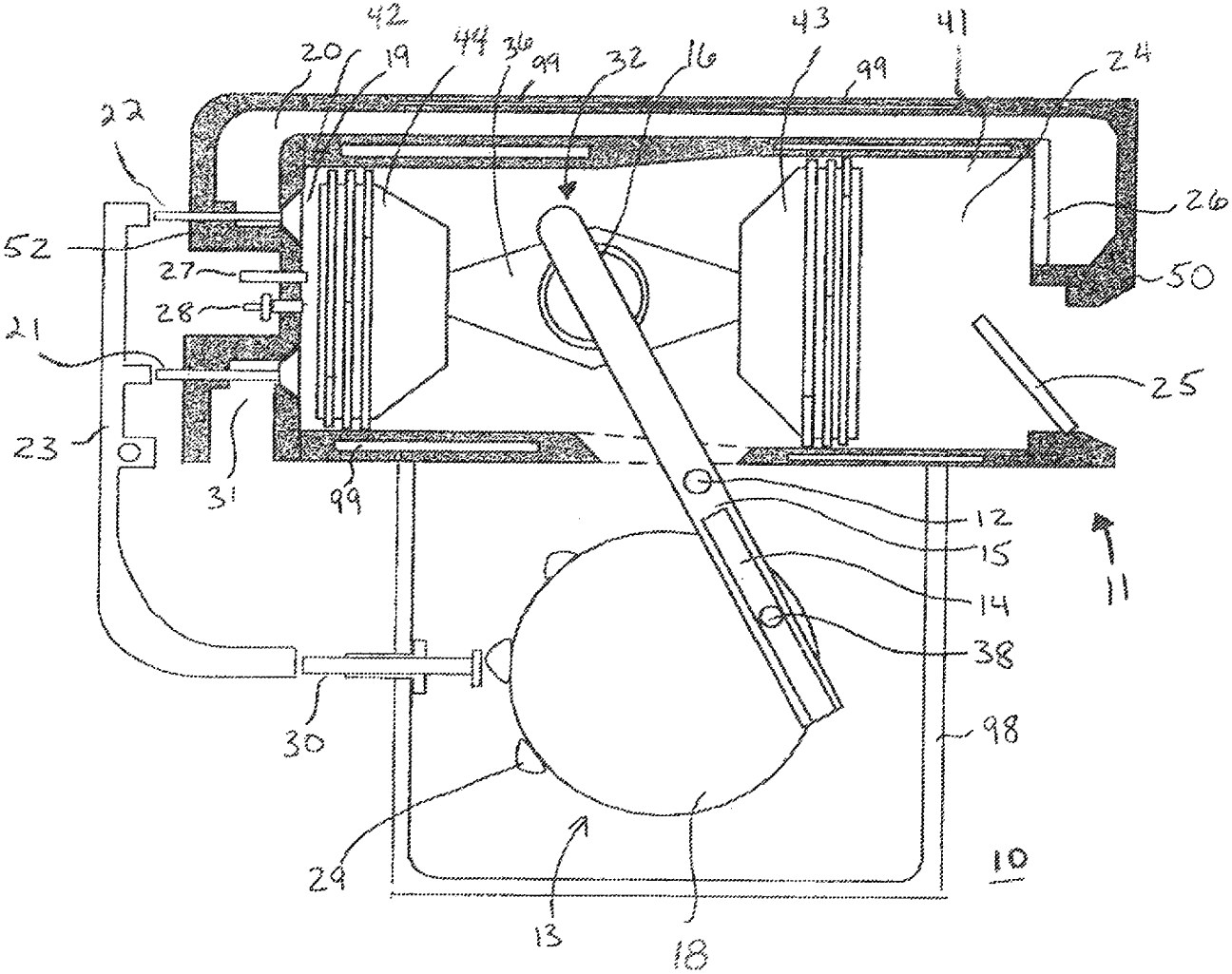
FIG. 1C is a front elevational cross-sectional diagrammatic view of the two-cycle engine shown in FIGS. 1A and 1B at a second different point in its combustion cycle.

Referring now to FIG. 1A, 1B and 1C, a two-stroke engine utilizing a single lever arm is illustrated. An embodiment of the present invention is shown in FIG. 1A diagrammatically which includes a cylinder block 11, having opposing first and second coaxial cylinders 8, 7, that supports the various working components of the engine. The upper half of cylinder block 11 contains a piston assembly 32 and the lower half contains a crankshaft assembly 13.

A plurality of cooling channels 99 are designed to permit the closed-loop circulation of a liquid (e.g., air, or a water and antifreeze solution) to assist in cooling the two-cycle engine.

The piston assembly 32 includes a first piston 18 and a second piston 17 fixedly coupled to each other and diametrically opposed to each other, mounted within the first and second coaxial cylinders 8, 7, respectively. A connecting rod 36 extends between the first piston 18 and the second piston 17 to connect the pistons 18, 17 together. The pistons 18, 17 are designed to slide within the cylinder block 11 in an oscillating manner.

A first cylinder head 50 is coupled to the end of the first coaxial cylinder 8, and a second cylinder head 52 is coupled to the end of the second coaxial cylinder 7. The oscillating piston assembly 32 defines a pumping space 24 between the first piston 18 and the interior of the first cylinder head 50 and also defines a combustion space 19 between the second piston 17 and the interior of the second cylinder head 52.

A transfer duct 20 provides fluid communication between the pumping space 24 and the combustion space 19, the transfer duct 20 provides a means for delivering a pressurized intake charge from the pumping space 24 to the combustion space 19.

The lower half of the cylinder block 11 includes a housing 98. The crankshaft assembly 13, including a flywheel 10, is rotatably mounted within the housing 98. A plurality of cams 29 are fixed to the perimeter of the flywheel 10. The operation and purpose of the cams 29 will be more fully disclosed hereafter.

The tracking pin 38 is affixed to flywheel 10 and communicates with slot 14 on lever arm 15. Lever arm 15 includes the slot 14 at the lower end, and a pinned connection 16 to connecting rod 36 at its opposite end. As the crankshaft assembly 13 rotates, the flywheel 10 rotates, and lever arm 15 rocks about the fulcrum pivot 12 which is rigidly affixed to the cylinder block 11. The lever arm 15 is further slotted in the area of the fulcrum pivot 12 to permit the necessary longitudinal movement of the lever arm 15 with respect to the fulcrum pivot 12. In this way, oscillatory motion of pistons 18, 17, which are rigidly connected to connecting rod 36, is achieved as the crankshaft and flywheel 10 rotate.

Another function of the housing 98 is to store a lubricating liquid (oil). The movement of lever arm 15 delivers a controlled amount of lubricating oil to the inner walls of the cylinder block 11 to allow the smooth operation of the pistons 18, 17 by reducing the friction between the perimeter of the pistons 18, 17 and the inner walls of the first and second coaxial cylinders 8, 7.

The crankshaft assembly 13 extends through the housing to a point outside of the housing. The crankshaft assembly 13 is designed to deliver the rotational energy developed by the subject engine to an external source (e.g., for connection to a transmission, cutting blades or similar items that will produce work). In one embodiment of the present invention the rotational energy of the crankshaft 13 is utilized to drive a twin-cylinder compressor 60. The operation of the twin-cylinder compressor 60 will be more fully disclosed hereafter.

A first lifter valve means 22 in the second cylinder head 52 controls the flow of exhaust from the combustion space 19 to ambient air external the cylinder block 11. In a preferred embodiment the first lifter valve means 22 is positioned away from the cylinder wall to prevent the escape of lubrication oil. A second lifter valve means 21 in the second cylinder head 52 controls the flow of the intake charge from the transfer duct 20.

A means for introducing a fuel charge communicates with the combustion space 19 for delivering a fuel charge into the combustion space 19. The present invention may use gasoline, diesel, or hydrogen as a fuel charge. If the engine is designed to operate on gasoline, then the fuel charge will consist of gasoline, and the delivery means may be a fuel injector 27. A means for igniting the fuel charge also communicates with the combustion space 19. Again, if the engine is designed to run on gasoline, the igniting means would include a sparkplug 28. If the engine is designed to run on diesel the igniting means would be the heat of compression formed within the combustion space 19.

The plurality of cams 29 located on the perimeter of the flywheel 10 are designed to move the lifting rod 30 as the flywheel 10 rotates which in turn causes the rocker arm 23 to control the operation of the first and second lifter valve means, 22 and 21 respectively. The cams 29 are spaced precisely on the perimeter of the flywheel 13 to open and close the lifter valves means 22, 21 in synchronization with the piston assembly 32 to provide the intake charge or remove the exhaust at the proper time in order to allow the engine to operate.

This type of engine utilizing only a single lever arm 15 as shown herein is employed in novel embodiments which will be later described in detail. The present invention uses opposing pistons 18, 17 of different diameter. In a preferred embodiment, the first piston or "pump piston" 18 functions as a pump to supply an intake charge to transfer duct 20 and then through the second lifter valve means 21 to the combustion space 19 proximate a second or combustion piston 17 (sometimes referred to as the "working piston") to provide two-cycle operation. The diameter of the pumping piston 18 is preferably larger than the diameter of the working piston 17. Because of the larger displacement of the pump utilizing the pump piston 18, together with its inherent volumetric efficiency, a greater amount of intake charge is provided to the combustion space 19 above the combustion piston 17 than can ordinarily be achieved by a crankshaft-scavenged two-cycle engine. In this configuration, the two-cycle engine may employ either diesel or electric spark ignition and may utilize either direct fuel injection or carburetion.

The delivery of the intake charge into the combustion chamber 19 is controlled by the second lifter valve means 21. In a preferred embodiment, the first lifter valve means 22 and the second lifter valve means 21 are poppet valves controlled by a rocker arm 23. The shape and position of the rocker arm 23 along with the number of cams 29 determine the valve lift, and when and how quickly the lifter valves means 22, 21 are opened. The control of the exhaust may be accomplished by the first lifter valve means 22.

Air/fuel intake to the combustion side of the engine may be achieved through the use of an injector 27. It will be readily appreciated that because the flow of fuel/air mixture is isolated from the crankcase and the spaces on the other side of the pistons that there is no need to add lubricating oil to the air/fuel mixture. This is an important advantage of the present invention. The various crankcase components are preferably lubricated by means well-known in the art of internal combustion engines, such as the means utilized in conventional four-cycle engines.

The operation of the two-stroke engine will be described with reference to FIGS. 1A, 1B and 1C. As the flywheel 10 turns the crankshaft 13, an intake charge is drawn into pumping space 24 between the first piston 18 and the cylinder head 50 and is passed by way of a transfer duct 20 to a combustion space 19 between the second piston 17 and the second cylinder head 52. The second cylinder head 52 includes exhaust means whereby after ignition of the fuel charge in the combustion space 19 the pistons 18, 17 are driven against the lever 15 means which in turn turns the crankshaft 13.

Referring now to FIG. 1B, as the pistons 18, 17 move from left to right, inlet reed valve 25 closes and outlet reed valve 26 opens. The outlet reed valve 26 controls entry of the intake charge to the transfer duct 20. Since outlet reed valve 26 is a one-way valve, any back pressure in the transfer duct 20 will close outlet reed valve 26.

In one embodiment, the pistons 18, 17 are of different diameter to increase the volumetric efficiency and, thus, provide a greater intake charge to the combustion space 19. A one-way valve may be included between the first pumping space 24 and the transfer duct 20 so that the intake charge will travel only in the direction into the transfer duct 20 and away from the pumping space 24. The exhaust means is preferably an exhaust port controlled by the first lifter valve means 22 in the second cylinder head 52. The first lifter valve means 22 may advantageously be timed to open while the second lifter valve means 21 is open and the pumping piston 17 is supplying an intake charge to the combustion space 19 through the transfer duct 20 in order to more efficiently remove exhaust gases from the combustion chamber 19. The first lifter valve means 22 may also be timed to close prior to the second lifter valve means 21 closing while the pumping piston 17 is supplying an intake charge through the transfer duct 20 to provide a greater intake charge to the combustion space 19. At approximately the pistons 18, 17 furthest point of travel to the right, both the first lifter valve means 22 and second lifter valve means 21 are closed.

Referring again to FIG. 1A, as the pistons 18, 17 return their motion towards the left, reed valve 26 begins to close in order to prevent the air charge from re-entering the pumping space 24. As the pistons 18, 17 further move to the left the air located within the combustion chamber 19 is pressurized.

Referring now to FIG. 1C, as the pistons 17, 18 continue to move from right to left a fuel charge is injected through injector 27. The fuel from the direct fuel injector 27 mixes with the air in the combustion chamber 19 to create an air/fuel mixture within combustion space 19. At approximately the pistons 18, 17 furthest point of travel to the left, the spark plug 28 fires and causes combustion within the combustion chamber 19, thus driving the pistons 17, 18 back to the right, thereby moving the lever arm 15 which in turn moves the flywheel 10 and crankshaft 13.

The operation, and in particular, the timing of the opening and closing of the first lifter valve means 22 and second lifter valve means 21 is controlled by the height, number and spacing of the cams 29 on the flywheel 10. The operation of the first lifter valve means 22 and the second lifter valve means 21 is also dictated by the shape of rocker arm 23. Every time a cam 29 engages the lifter 30, the second lifter valve means 21 opens and the first lifter valve means 22 closes; after the cam 29 ceases engagement of the lifter 30, the first lifter valve means 22 closes and the second lifter valve means 21 opens.

Figure 2:
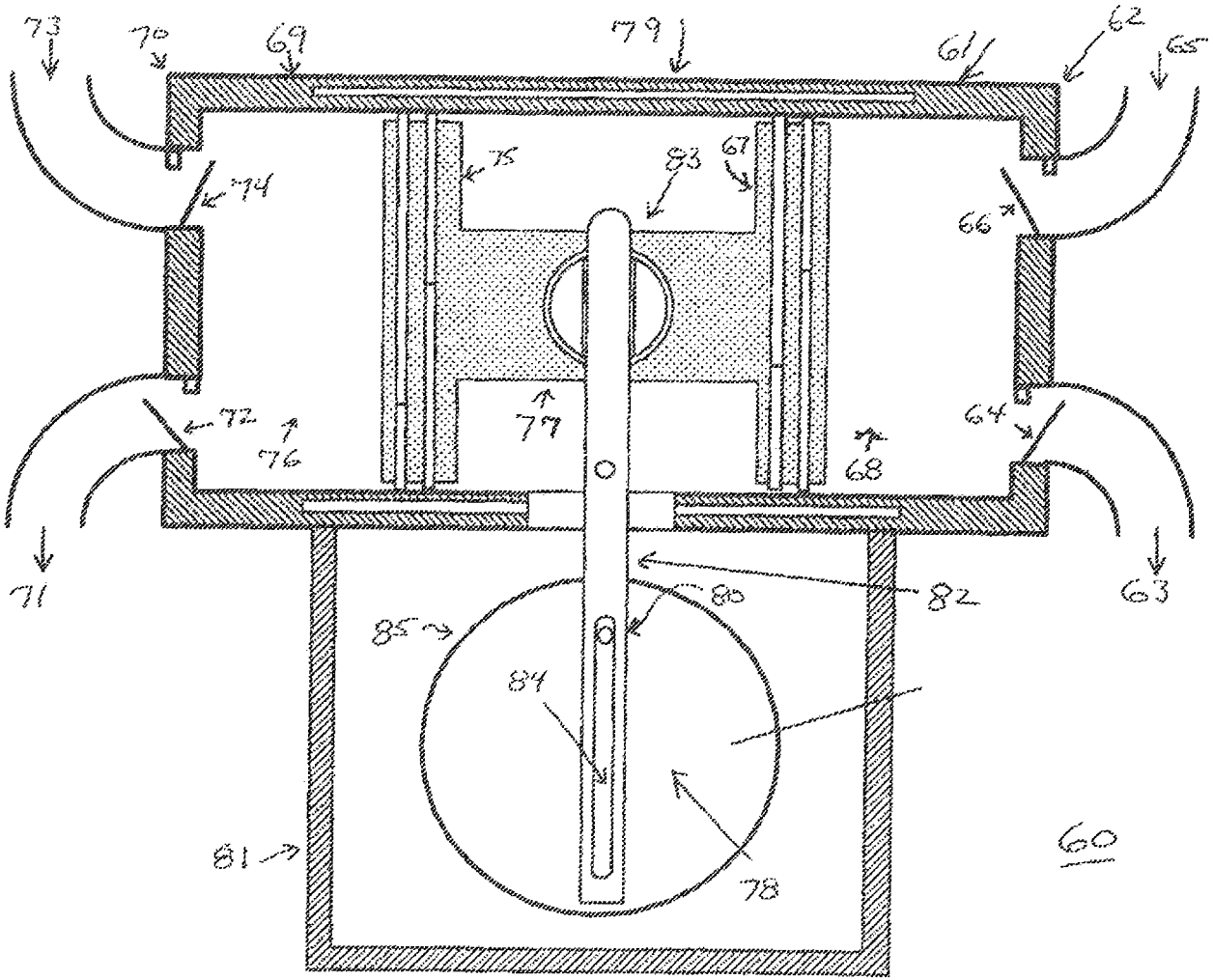
FIG. 2 is a front elevational partial cross-sectional diagrammatic view of the twin-cylinder compressor.

Referring now to FIG. 2, which shows a twin-cylinder compressor 60. The twin cylinder compressor has a housing 63 for storing a lubricating liquid (oil). Positioned within the housing 63 is a flywheel 64 having a first planar surface and a second planar surface. A guide pin 65 is affixed to the first planar surface of the flywheel 64 and extends away from the first planar surface. The flywheel 64 is mounted to a crankshaft 66 which originates from outside the housing 63, extending through the housing 63 and is axially connected to the second planar surface of the flywheel 64. The crankshaft 66 and flywheel 64 are mounted such that they may move in a rotating manner.

Mounted above the housing 63 is an elongate cylinder block 67 having opposing first 68 and second 69 coaxial cylinders. A first cylinder head 70 is coupled to the end of the first cylinder 68, and a second cylinder head 71 is coupled to the end of said second cylinder 69.

A piston assembly 72 is designed to slide within the cylinder block 67 in an oscillating manner, the piston assembly 72 having a first piston 53 and a second piston 51 where the pistons are fixedly coupled to and diametrically opposed to one another.

A connecting rod 73 extends between the first 53 and the second 51 pistons so that the first 53 and second 51 pistons move in synchronization with each other. The piston assembly 72 defines a first pumping space 74 between the first piston 53 and the interior of the first cylinder head 70 and also defines a second pumping space 75 between the second piston 51 and the interior of the second cylinder head 71.

The first inlet port 59 communicates with the first pumping space 74 via the first one-way inlet valve 54 and the first exhaust port 62 communicates with the first pumping space 74 via the first one-way exhaust valve 55.

The second inlet port 58 communicates with the second pumping space 75 via the second one-way inlet valve 56 and the second exhaust port 61 communicates with the second pumping space 75 via the second one-way exhaust valve 57.

A lever arm 76 having a first end and a second end connects at the first end to the mid-point of the connecting rod 73, the second end of the lever arm 76 including a slot 77 extends through a side of the cylinder block 67 and into the housing 63 so that the slot 77 can communicate with a guide pin 78 on the flywheel 64. The flywheel 64, guide pin 78, slot 77, lever arm 76 and connecting rod 73 are designed to convert the rotational movement of the crankshaft 66 into oscillating movement of the piston assembly 72.

The exhaust valves 55, 57 work in concert with the oscillation of the piston assembly 72 to provide a pressurized fluid source. When the first piston 53 moves towards the first cylinder head 70 the volume of the first pumping space 74 is reduced and the fluid pressure is increased within the first pumping space 74. Simultaneously the second piston 51 moves with the first piston 53 and the second piston 51 moves away from the second cylinder head 71 thereby increasing the volume of second pumping space 75. The volume of the pumping spaces 74, 75 are constantly changing by the substantially simultaneous operation of the inlet valves 54, 56 and the exhaust valves 55, 57 such that first inlet valve 54 closes preventing fluid movement from the first inlet port 59 while the first exhaust valve 55 opens thereby allowing fluid movement out of the first pumping space 74. The second piston 51 moves away from the second cylinder head 71 thereby increasing the volume of second pumping space 75 by closing second exhaust valve 57 thereby preventing any fluid movement through the second exhaust port 61 while opening the second inlet valve 56 thereby allowing fluid to move into the second pumping space 75. When the pistons 51, 53 reach their maximum movement in one direction, they begin to move in the opposite direction. This change in direction increases the volume of the first pumping space 74 and decreases the volume of the second pumping space 75, simultaneously closing the first exhaust valve 55 while opening the first inlet valve 54, allowing the first piston 53 to draw in fluid through the first inlet port 59, and closing the second inlet valve 56 while opening the second exhaust valve 57. This allows fluid to escape from the second pumping space 75 and provides a relatively high fluid pressure at the second exhaust port 61.

The exhaust valves 55, 57 may be connected together in order to provide a more powerful pumping action than a single-piston pump having a similar displacement. The means to do so would be known to one of ordinary skill in the art of compressors.

In another embodiment of the compressor 60 the inlet valves 54, 56 and the exhaust valves 55, 57 may be mechanically connected with each other and directly or indirectly connected to the lever arm 76 for precise timing of their respective movements.

An electric motor or a combustion engine may be used as the driving force for the compressor. The driving force may be applied to the portion of the crankshaft 66 that is external to the housing 63 in providing the rotational energy needed to turn the crankshaft 66 and thus oscillate the pistons 51, 53.

By the mechanical relations disclosed herein, it will be appreciated that the present invention contains improvements over the prior art. The present device provides an operating mechanism for a two-cycle internal combustion engine in which the crankshaft is isolated from the fuel charge so that the fuel need not contain lubricating oil. This provides the advantage of greater power and reduced environmental pollution from the exhaust. In addition, this two-cycle engine may include supercharging through the use of independently-timed exhaust valves and a pumping piston which has an operating volume greater than that of the combustion piston. Even without the use of valve timing that would permit supercharging, the present device permits greater power output due to increased fuel charge provided by the intake pumping means having an enlarged swept volume. These many advantages provide a great advancement over prior art engines which are not capable of achieving the same results.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A two-cycle engine, comprising:

an elongate cylinder block having opposing first and second coaxial cylinders;

a piston assembly designed to slide within said cylinder block in an oscillating manner, said piston assembly having a first piston and a second piston, said first piston and a second piston fixedly coupled to and diametrically opposed;

a first cylinder head coupled to the end of said first cylinder, and a second cylinder head coupled to the end of said second cylinder;

said piston assembly defining a pumping space between said first piston and the interior of said first cylinder head and also defining a combustion space between said second piston and the interior of said second cylinder head;

a transfer duct for providing fluid communication between said pumping space and said combustion space, said transfer duct providing a pressurized intake charge from said pumping space to said combustion space;

a connecting rod extending between said first and said second pistons;

a housing for storing a lubricating liquid (oil);

a crankshaft positioned within said housing, said crankshaft rotatably movable;

means affixed to said connecting rod for converting the oscillating motion of said first and second pistons into rotary motion of the crankshaft;

one-way valve means in said first cylinder head for controlling the flow of an intake charge into said pumping space;

a first lifter valve means in said second cylinder head for controlling the flow of an exhaust charge from said combustion space to ambient air external to said cylinder block;

a second lifter valve means in said second cylinder head for controlling the flow of said intake charge from said transfer duct;

means for introducing a fuel charge into said combustion chamber;

ignition means located in said second cylinder for igniting a fuel charge;

a plurality of cams located on the perimeter of said crankshaft, said cams communicating with a lifting rod which causes a rocker arm to control the operation of said first and second lifter valve means; and exhaust means in fluid communication with said combustion space, whereby oscillation of said coupled pistons draws an intake charge into said pumping space and then forces said intake charge from said pumping space through said duct means to said combustion space, wherein said second piston compresses said charge, and upon ignition, said ignited charge drives said second piston forceably, turning said crankshaft and wherein said means for converting the oscillation of said pistons to rotary motion of a single crankshaft, comprises a lever arm, rotatably and slidably mounted to said cylinder block.

2. The two-cycle engine of claim 1, wherein said first piston has a larger diameter than the diameter of said second piston, and therefore a larger displacement.

3. The two-cycle engine of claim 2, further including a one-way valve between said pumping space and said transfer duct which permits the intake charge to travel only in the direction into said duct and away from said pumping space, said one-way valve and said second lifter valve means synchronized with each other so that when said one-way valve opens and intake charge is pushed and drawn into said transfer duct, said second lifter valve opens approximately simultaneously to allow said charge into the combustion chamber.

4. The two-cycle engine of claim 1 wherein said means for introducing a fuel charge into said combustion chamber comprises a fuel injector positioned through the cylinder block.

5. The two-cycle engine of claim 3, wherein said first lifter valve means is positioned away from the cylinder wall to prevent the escape of lubrication oil.

6. The two-cycle engine of claim 1 wherein the fuel charge consists of gasoline and said ignition means includes a spark plug.

7. The two-cycle engine of claim 1 wherein the fuel charge consists of diesel and said ignition means is the heat and compression formed within said combustion space.

8. The two-cycle engine of claim 1 wherein the fuel charge consists of hydrogen.

9. A compressor, comprising:

a housing for storing a lubricating liquid (oil);

a flywheel positioned within said housing, said flywheel having a first planar surface and a second planar surface;

a guide pin that extends away from said first planar surface of the flywheel;

a crankshaft originating from outside said housing, extending through said housing and axially connected to said second planar surface of the flywheel, said crankshaft and flywheel rotatably movable;

an elongate cylinder block having opposing first and second coaxial cylinders, said elongate cylinder block mounted directly over said housing;

a first cylinder head coupled to the end of said first cylinder, and a second cylinder head coupled to the end of said second cylinder;

a piston assembly designed to slide within said cylinder block in an oscillating manner, said piston assembly having a first piston and a second piston, said first piston and a second piston fixedly coupled to and diametrically opposed;

a connecting rod extending between said first and said second pistons, so that said first and second pistons move in synchronization with each other, said piston assembly defining a first pumping space between said first piston and the interior of said first cylinder head and also defining a second pumping space between said second piston and the interior of said second cylinder head;

a first inlet port that communicates with said first pumping space via a first one-way inlet valve;

a first exhaust port that communicates with said first pumping space via a first one-way exhaust valve;

a second inlet port that communicates with said second pumping space via a second one-way inlet valve;

a second exhaust port that communicates with said second pumping space via a second one-way exhaust valve;

a lever arm having a first end and a second end, the first end of said lever arm connected proximate a mid-point of the connecting rod, the second end of the lever arm including a slot, the lever arm extending through a side of said elongate cylinder block and into said housing so that the slot can communicate with said guide pin on the flywheel, said flywheel, guide pin, slot, lever arm, and connecting rod designed to convert rotational movement of said crankshaft into oscillating movement of said pistons;

said exhaust valves working in concert with the oscillation of said pistons such that when said first piston moves towards said first cylinder head thereby reducing the volume of said first pumping space and increasing the fluid pressure within said first pumping space, said second piston moving with said first piston said second piston simultaneously moves away from said second cylinder head thereby increasing the volume of second pumping space, said volume of the pumping spaces changing by the substantially simultaneous operation of said inlet valves and said exhaust valves such that first inlet valve closes preventing fluid movement from said first inlet, first exhaust opens thereby allowing fluid movement out of said first pumping space, said second piston moves away from said second cylinder head thereby increasing the volume of second pumping space by closing second exhaust valve thereby preventing any fluid movement through said second exhaust port, opening said second inlet valve thereby allowing fluid to move into the second pumping space, when said pistons reach their maximum movement in one direction, they begin to move in the opposite direction, increasing the volume of the first pumping space and decreasing the volume of the second pumping space, by substantially simultaneously closing said first exhaust valve, opening said first inlet valve, allowing the first piston to draw in fluid through said first inlet, and closing said second inlet valve, opening said second exhaust valve thereby allowing fluid to escape from the second pumping space and providing a relatively high fluid pressure at the second exhaust port.

10. The compressor of claim 9 wherein said first and second inlet valves and said first and second exhaust valves operate solely on the air pressures created within their respective pumping spaces.

11. The compressor of claim 9 wherein said first and second inlet valves and said first and second exhaust valves are all mechanically connected with each other and directly or indirectly connected to said lever arm for precise timing of their respective movements.

12. The compressor of claim 9 wherein a motor is connected to said portion of the crankshaft originating outside of the housing for providing rotational energy.

13. The compressor of claim 12 wherein said motor is an electric motor.

14. The compressor of claim 12 wherein said motor is a combustion engine.

15. The compressor of claim 12 further comprising means to connect said first and second exhaust valves together in order to provide a more powerful pumping action than single-piston pumps having a similar displacement.

* * * * *